US008579643B2

(12) United States Patent
Farnsworth

(10) Patent No.: US 8,579,643 B2
(45) Date of Patent: Nov. 12, 2013

(54) CONNECTOR ASSEMBLY AND METHOD OF FABRICATING THE SAME

(75) Inventor: Victor Paul Farnsworth, Jacksonville, FL (US)

(73) Assignee: Unison Industries, LLC, Jacksonville, FL (US)

( * ) Notice: Subject to any disclaimer, the term of this patent is extended or adjusted under 35 U.S.C. 154(b) by 99 days.

(21) Appl. No.: 13/341,206

(22) Filed: Dec. 30, 2011

(65) Prior Publication Data

US 2013/0170957 A1 Jul. 4, 2013

(51) Int. Cl.
*H01R 13/52* (2006.01)

(52) U.S. Cl.
USPC ..... 439/275; 439/587; 439/321

(58) Field of Classification Search
USPC ..... 439/275, 274, 587–589, 321
See application file for complete search history.

(56) References Cited

U.S. PATENT DOCUMENTS

| | | | | |
|---|---|---|---|---|
| 2,605,315 | A * | 7/1952 | Hargett | 439/275 |
| 3,124,405 | A * | 3/1964 | Massa | 439/282 |
| 3,335,396 | A * | 8/1967 | Nava et al. | 439/744 |
| 3,748,632 | A | 7/1973 | Tanges, Jr. | |
| 3,789,346 | A * | 1/1974 | De Brick | 439/283 |
| 4,005,922 | A | 2/1977 | Burkhart et al. | |
| 4,196,390 | A | 4/1980 | Pitkin | |
| 4,547,035 | A | 10/1985 | Espiritu | |
| 4,728,296 | A | 3/1988 | Stamm | |
| 5,022,865 | A | 6/1991 | Wright et al. | |
| 5,471,741 | A | 12/1995 | Heisner et al. | |
| 7,422,459 | B2 | 9/2008 | Hopper | |
| 7,695,331 | B2 | 4/2010 | Kerner | |

* cited by examiner

*Primary Examiner* — Gary Paumen
(74) *Attorney, Agent, or Firm* — Matthew P. Hayden, Esq.; Armstrong Teasdale LLP

(57) ABSTRACT

A method of fabricating a connector assembly for connecting a wire to a device of a gas turbine engine is provided. The method includes providing a wire having a termination and providing a first shell having a first proximal end, a first distal end, and a first passage extending from the first proximal end to the first distal end. The method further includes coupling the first shell to the wire such that the wire extends into the first passage through the first proximal end, wherein the first shell is displaceable along the wire relative to the termination.

20 Claims, 8 Drawing Sheets

CONNECTOR ASSEMBLY AND METHOD OF FABRICATING THE SAME

BACKGROUND OF THE INVENTION

The field of this disclosure relates generally to connector assemblies and, more particularly, to a connector assembly for connecting a wire to a device.

Many known systems (e.g., automobiles, watercraft, aircraft, spacecraft, etc.) utilize a plurality of devices (e.g., electro-mechanical devices such as motors, pumps, and sensors). At least some of these known systems utilize harnesses to route bundles of wires through the system in an organized manner that enables providing electrical power to, or communication with, the devices with minimal interference between the devices and the wires. It would be useful to provide an improved interface between the wires and the devices to reduce costs associated with manufacturing, installing, and operating the systems.

BRIEF DESCRIPTION OF THE INVENTION

In one aspect, a method of fabricating a connector assembly for connecting a wire to a device of a gas turbine engine is provided. The method includes providing a wire having a termination and providing a first shell having a first proximal end, a first distal end, and a first passage extending from the first proximal end to the first distal end. The method further includes coupling the first shell to the wire such that the wire extends into the first passage through the first proximal end, wherein the first shell is displaceable along the wire relative to the termination.

In another aspect, a connector assembly for connecting a termination of a wire to a device of a gas turbine engine is provided. The connector assembly includes a first grommet structure configured to be coupled to the wire and a first shell having a first proximal end, a first distal end, and a first passage extending from the first proximal end to the first distal end. The first shell is configured to be coupled to the wire such that the wire extends into the first passage through the first proximal end. The first shell is also configured to be displaceable along the wire relative to the termination and the first grommet structure from a first position in which the first grommet structure is disposed within the first passage to a second position in which the first grommet structure is exposed outside of the first passage.

In another aspect, a gas turbine engine is provided. The gas turbine engine includes a device, a wire having a termination, and a connector assembly operatively coupling the termination to the device. The connector assembly includes a first shell having a first proximal end, a first distal end, and a first passage extending from the first proximal end to the first distal end. The first shell is coupled to the wire such that the wire extends into the first passage through the first proximal end, and the first shell is displaceable along the wire relative to the termination.

DETAILED DESCRIPTION OF THE INVENTION

The following detailed description sets forth a connector assembly and a method of fabricating the same by way of example and not by way of limitation. The description should clearly enable one of ordinary skill in the art to make and use the connector assembly, and the description sets forth several embodiments, adaptations, variations, alternatives, and uses of the connector assembly, including what is presently believed to be the best mode thereof. The connector assembly is described herein as being applied to a preferred embodiment, namely an electrical harness for a gas turbine engine. However, it is contemplated that the connector assembly and the method of fabricating the same have general application in a broad range of systems and/or a variety of other commercial, industrial, and/or consumer applications.

Figure 1:
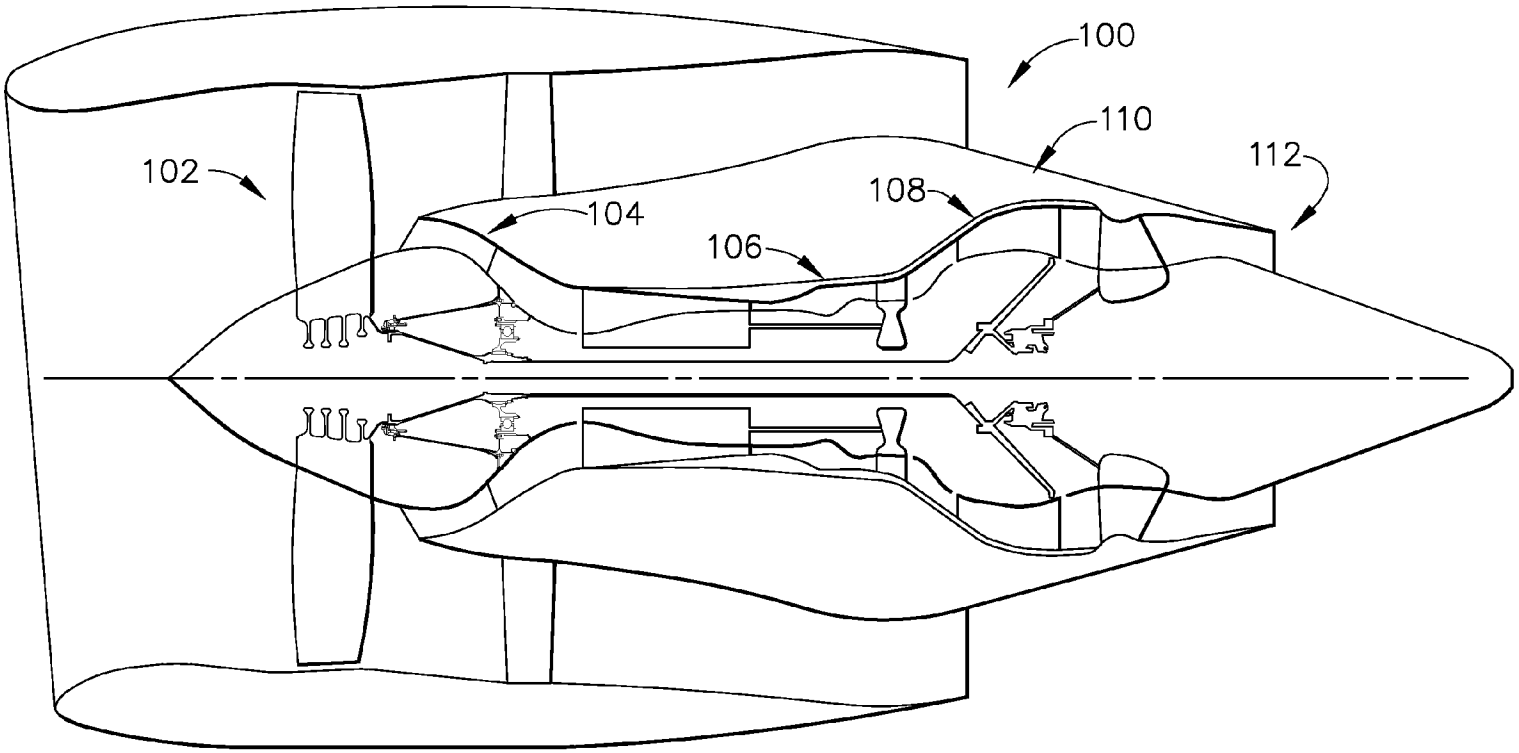
FIG. 1 is a schematic illustration of a gas turbine engine.

FIG. 1 is a schematic illustration of an exemplary gas turbine engine 100 including a fan system 102, a compressor system 104, a combustion system 106, a high pressure turbine system 108, and a low pressure turbine system 110. During operation, ambient air is directed through fan system 102 into compressor system 104, in which the ambient air is compressed and directed into combustion system 106. In combustion system 106, the compressed air is mixed with fuel and ignited to generate combustion gases that are directed through high pressure turbine system 108 and low pressure turbine system 110. The combustion gases are subsequently exhausted from gas turbine engine 100 via an exhaust system 112. In other embodiments, gas turbine engine 100 may include any suitable number of fan systems, compressor systems, combustion systems, and/or turbine systems configured in any suitable manner.

Figure 2:
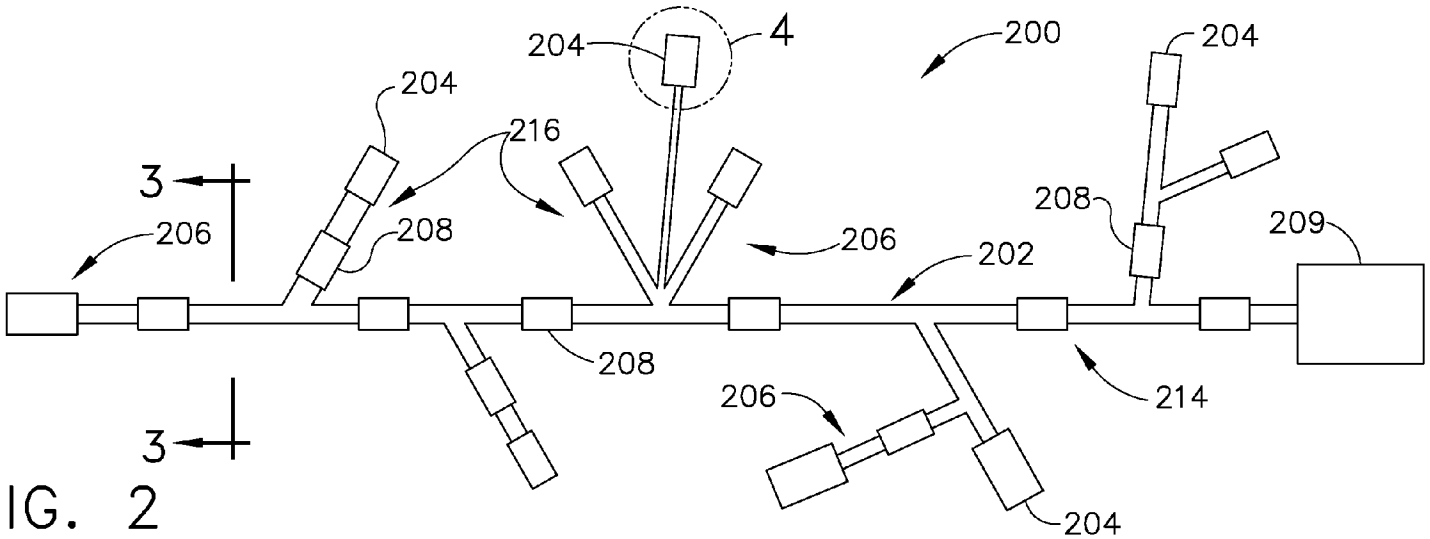
FIG. 2 is a schematic illustration of an electrical or communication system of the gas turbine engine shown in FIG. 1.
Figure 3:
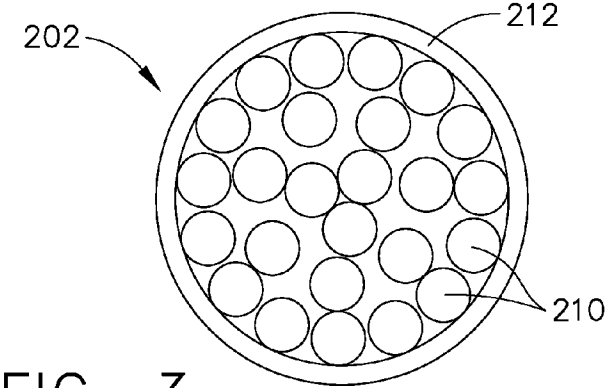
FIG. 3 is a schematic cross-sectional illustration of the system shown in FIG. 2 taken along line 3-3.

FIG. 2 is a schematic illustration of an electrical or communication system 200 of gas turbine engine 100, and FIG. 3 is a schematic cross-sectional illustration of system 200 taken along line 3-3. In the exemplary embodiment, system 200 includes a harness 202, a plurality of devices 204 (e.g., electrical devices such as motors, pumps, sensors, etc.) coupled to ends 206 of harness 202, and a plurality of mounting devices 208 coupled at intermediate locations along harness 202 between ends 206. System 200 also includes an electrical or communication source 209 (e.g., a generator or a control unit) for providing electrical power to, or communication with, devices 204 via harness 202. Harness 202 includes at least one wire 210 that may be disposed within a covering 212 (e.g., a layer of a braided material) to facilitate protecting wire 210 from chaffing and/or electromagnetic interference (EMI). Harness 202 has a main segment 214 and a plurality of breakout segments 216 extending from main segment 214, thereby enabling wire 210 to be more easily routed to devices 204.

Figure 4:
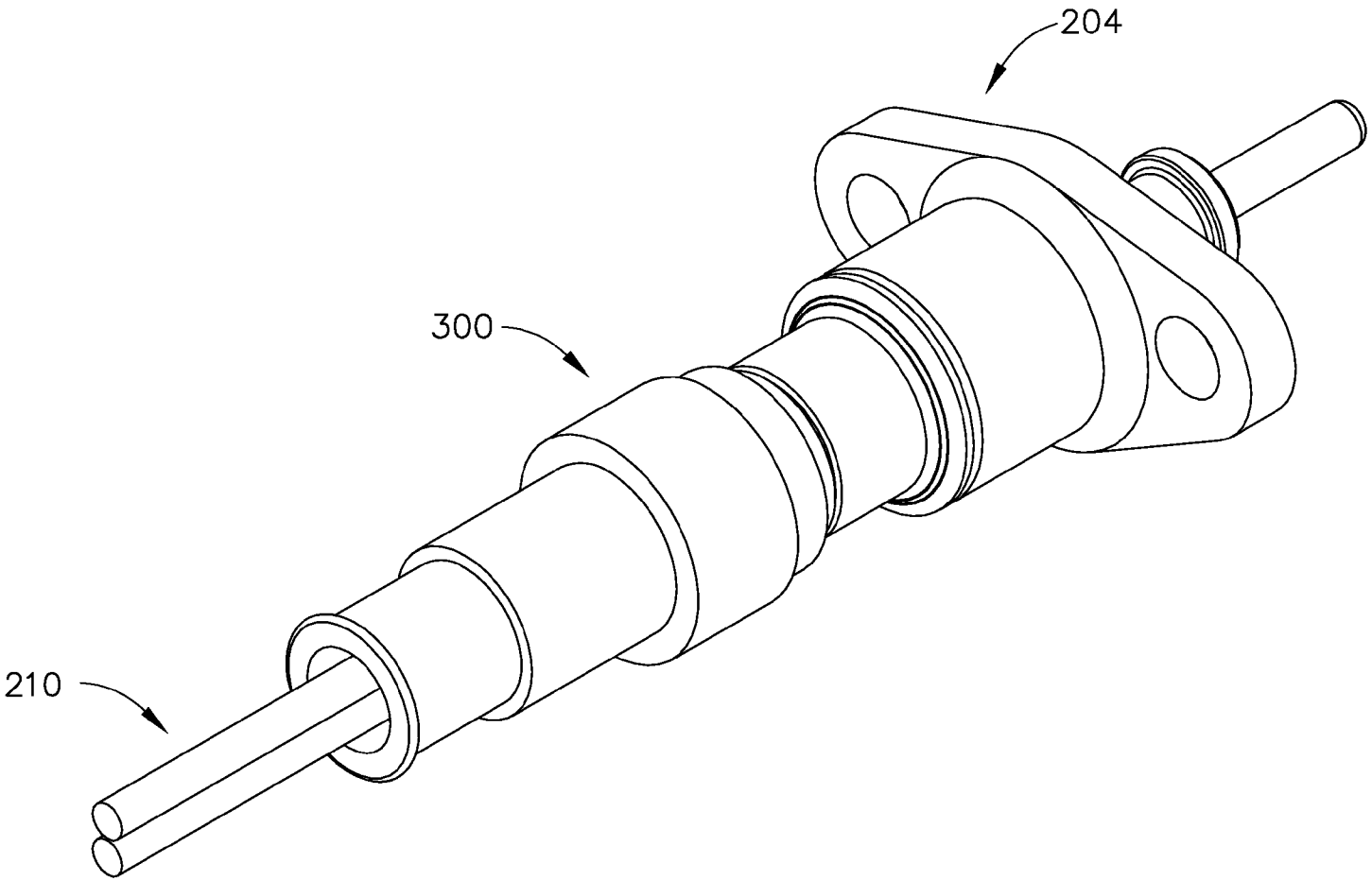
FIG. 4 is a perspective view of a portion of the system shown in FIG. 2 (taken within Portion 4) illustrating a device coupled to a wire via a connector assembly.
Figure 5:
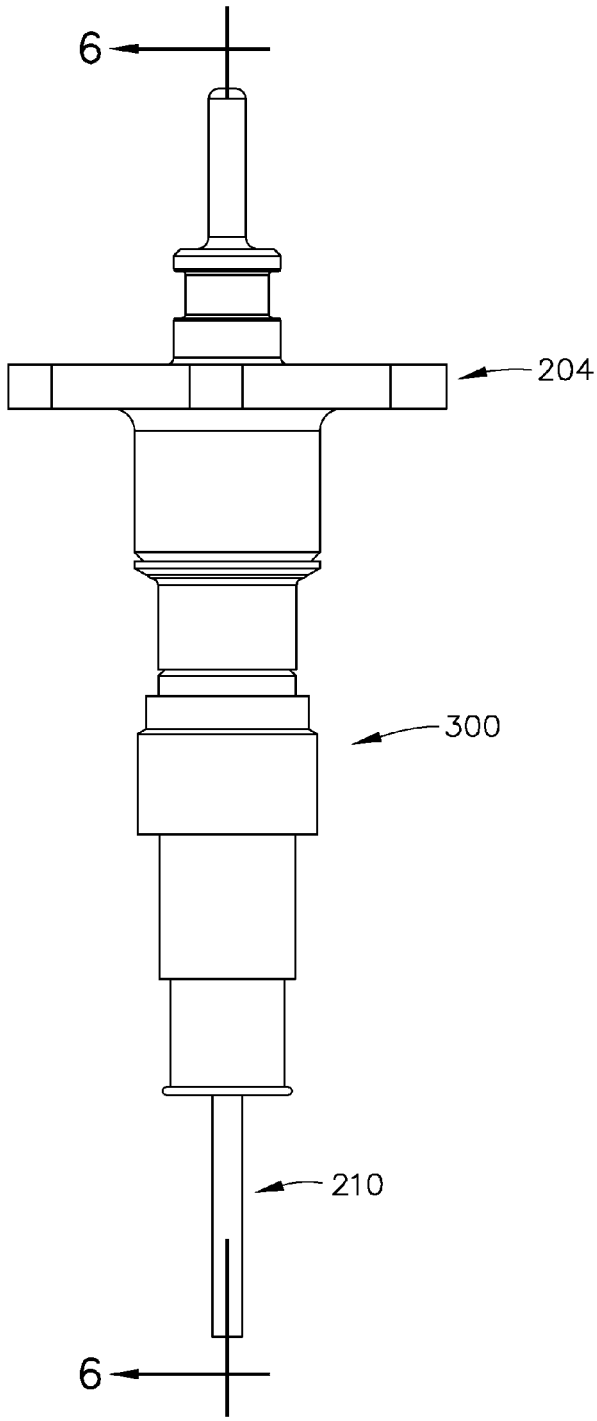
FIG. 5 is a side view of the connector assembly shown in FIG. 4.
Figure 6:
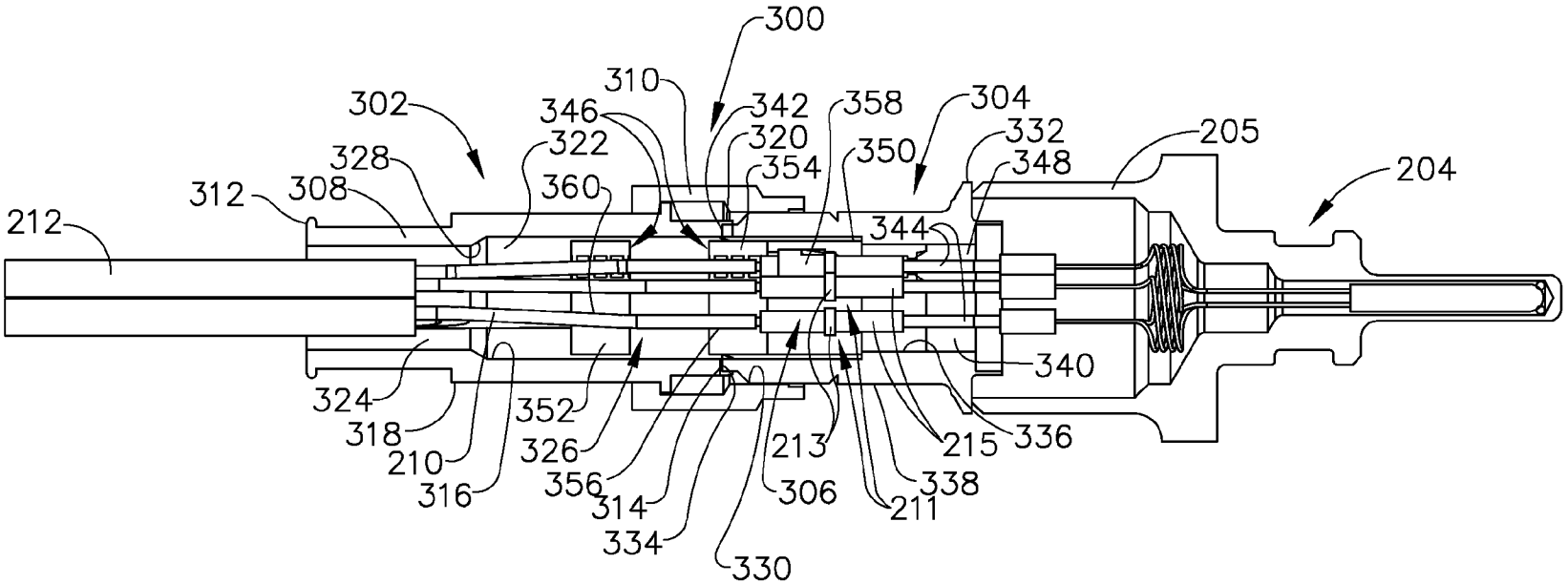
FIG. 6 is a cross-sectional view of the connector assembly shown in FIG. 4 and taken along line 6-6 of FIG. 5.

FIG. 4 is a perspective view of a portion of system 200 (taken within Portion 4 of FIG. 2) illustrating one device 204 coupled to wires 210 via a connector assembly 300. FIG. 5 is a side view of connector assembly 300, and FIG. 6 is a cross-sectional view of connector assembly 300 taken along line 6-6 of FIG. 5. In the exemplary embodiment, connector assembly 300 includes a first shell 302, a second shell 304, and a wire connection 306 housed within first and second shells 302, 304.

In the exemplary embodiment, first shell 302 includes a generally cylindrical body 308 and an annular coupling segment 310. Body 308 has a proximal end 312, a distal end 314, a radially inner surface 316, and a radially outer surface 318. Distal end 314 has a plurality of teeth 320, and radially inner surface 316 extends from proximal end 312 to distal end 314 to define a passage 322. Passage 322 has a proximal region 324 near proximal end 312 and a distal region 326 near distal end 314, and proximal region 324 is narrower than distal region 326 such that a lip 328 is defined between proximal region 324 and distal region 326. Coupling segment 310 is integrally formed with, and extends distally from, body 308 and includes a threaded inner surface 330. In one embodiment, coupling segment 310 and body 308 are integrally formed together from a metallic material (e.g., a stainless steel material). In other embodiments, first shell 302 may have any suitable configuration that facilitates enabling connector assembly 300 to function as described herein (e.g., coupling segment 310 may be rotatable relative to body 308 to facilitate threadably coupling first shell 302 to second shell 304 via threaded inner surface 330 as described below).

In the exemplary embodiment, second shell 304 is generally cylindrical and has a proximal end 332, a distal end 334, a radially inner surface 336, and a radially outer surface 338. Radially inner surface 336 extends from proximal end 332 to distal end 334 to define a passage 340. Second shell 304 is fabricated from a metallic material (e.g., a stainless steel material) and is configured to be coupled to (e.g., welded to) a housing 205 of device 204 at proximal end 332. Outer surface 338 is threaded near distal end 334, and distal end 334 has a plurality of teeth 342 that are configured to mate with (e.g., be interdigitated with) teeth 320 of first shell 302. In other embodiments, second shell 304 may have any suitable shape, may be fabricated from any suitable material, and may be coupled to housing 205 of device 204 in any suitable manner (e.g., second shell 304 may be fabricated from a plastic material and may be integrally formed with housing 205 in some embodiments). Additionally, second shell 304 may have any suitable configuration near proximal end 332 and/or distal end 334 that facilitates coupling second shell 304 to first shell 302 and device 204 in the manner described herein. As used herein, references to first shell 302 and/or second shell 304 in terms of orientation within (e.g., references such as first shell 302 or second shell 304 has an 'proximal end' or an 'distal end') are intended to mean that first shell 302 and second shell 304 are configured to be oriented in such a manner when connector assembly 300 is at least partially assembled as described herein, and such references to orientation are not intended to limit the scope of this disclosure to only those connector assemblies that are actually assembled. Rather, this disclosure is intended to apply to connector assemblies in general, whether assembled or not.

Wire connection 306 includes at least one wire 210, at least one contact 344 (e.g., a pin), and a support assembly 346. In the exemplary embodiment, wire connection 306 includes four contacts 344 and four corresponding wires 210. In other embodiments, wire connection 306 may have any suitable number of contacts 344 and wires 210. In the exemplary embodiment, contacts 344 are operatively coupled to device 204 (e.g., to provide power to device 204 or to provide communication with device 204) and extend into passage 340 via proximal end 332 of second shell 304. Each wire 210 includes a termination 211 having a retainer ring 213 and a socket contact 215, and wires 210 extend into passage 322 via proximal end 312 of first shell 302. In other embodiments, contacts 344 and wires 210 may be configured in any suitable manner that facilitates enabling connector assembly 300 to function as described herein.

In the exemplary embodiment, support assembly 346 includes a ceramic structure 348, a rigid dielectric structure 350, a first rigid grommet structure 352, and a second rigid grommet structure 354 (e.g., a sealing grommet structure). Ceramic structure 348, dielectric structure 350, and second grommet structure 354 are fixedly coupled within second shell 304 (e.g., via an adhesive) such that ceramic structure 348 is adjacent proximal end 332, second grommet structure 354 is adjacent distal end 334, and dielectric structure 350 is disposed between ceramic structure 348 and second grommet structure 354. At least one through-port 356 is defined through ceramic structure 348, dielectric structure 350, and second grommet structure 354 and extends generally from distal end 334 to proximal end 332. In the exemplary embodiment, four through-ports 356 are provided to correspond with four wires 210 and four contacts 344. In other embodiments, any suitable number of through-ports 356 may be provided. In the exemplary embodiment, a retention mechanism (e.g., a tapered retainer sleeve 358) lines a portion of each through-port 356 in dielectric structure 350. Alternatively, support assembly 346 may be configured with any suitable number of ceramic structures, dielectric structures, and/or second grommet structures arranged in any suitable manner that facilitates enabling connector assembly 300 to function as described herein.

In the exemplary embodiment, first grommet structure 352 is coupled to, and is displaceable along, wires 210 via a plurality of through-ports 360 defined in first grommet structure 352. First shell 302 is also displaceable along wires 210. In this manner, first grommet structure 352 and first shell 302 are displaceable relative to one another along wires 210. Because first grommet structure 352 is configured to be disposed within distal region 326 of passage 322 and is sized to be larger than proximal region 324 of passage 322, first grommet structure 352 facilitates preventing first shell 302 from being removed from wires 210 because first grommet structure 352 would contact lip 328 and provide a limit stop for displacing first shell 302 toward terminations 211. In other embodiments, wires 210, first shell 302, and first grommet structure 352 may be configured in any suitable manner that facilitates enabling connector assembly 300 to function as described herein.

Figure 7:
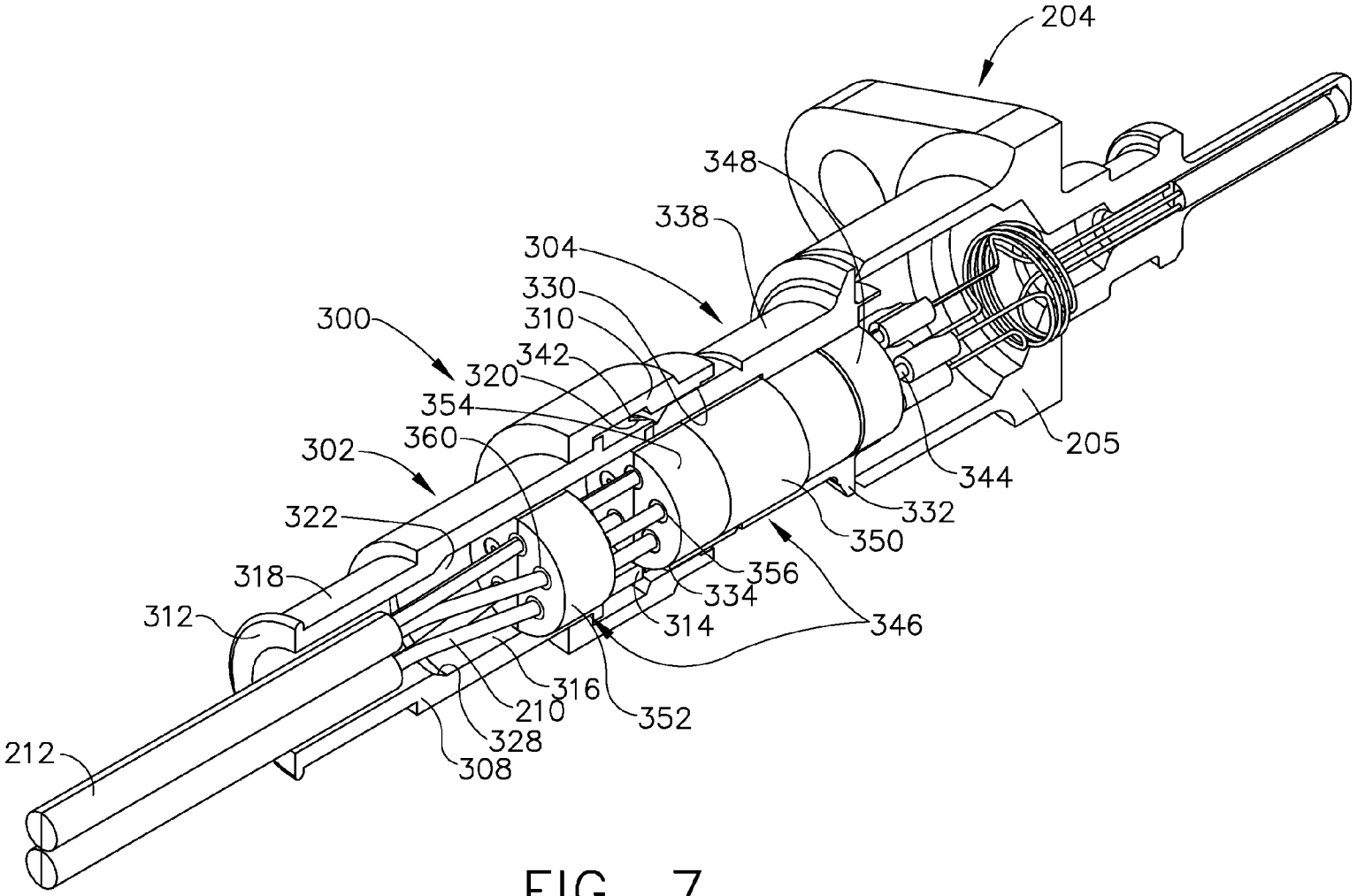
FIG. 7 is a partial perspective view of the connector assembly shown in FIG. 4 in an assembled state.
Figure 8:
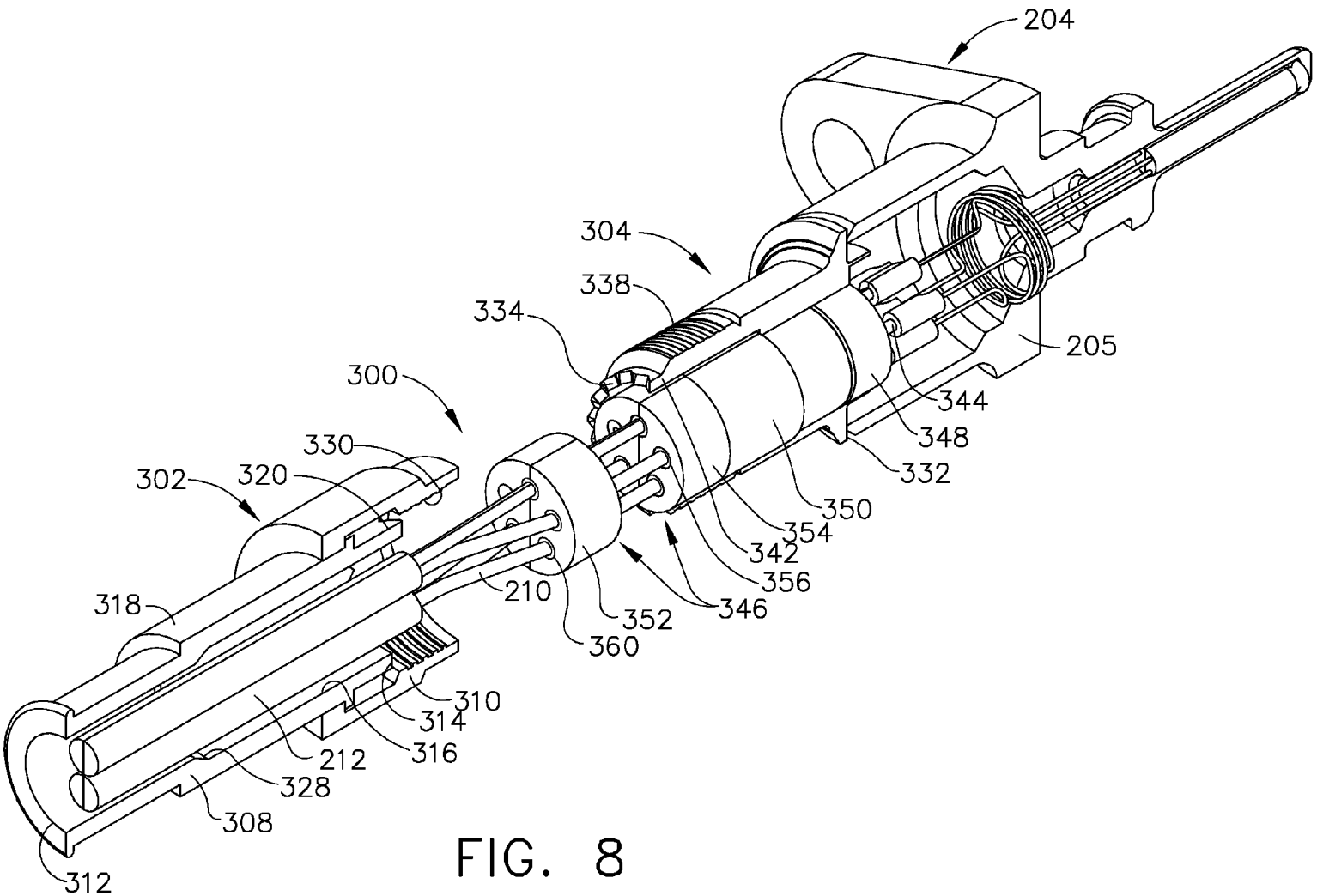
FIG. 8 is a partial perspective view of the connector assembly shown in FIG. 4 in a first disassembled state.
Figure 9:
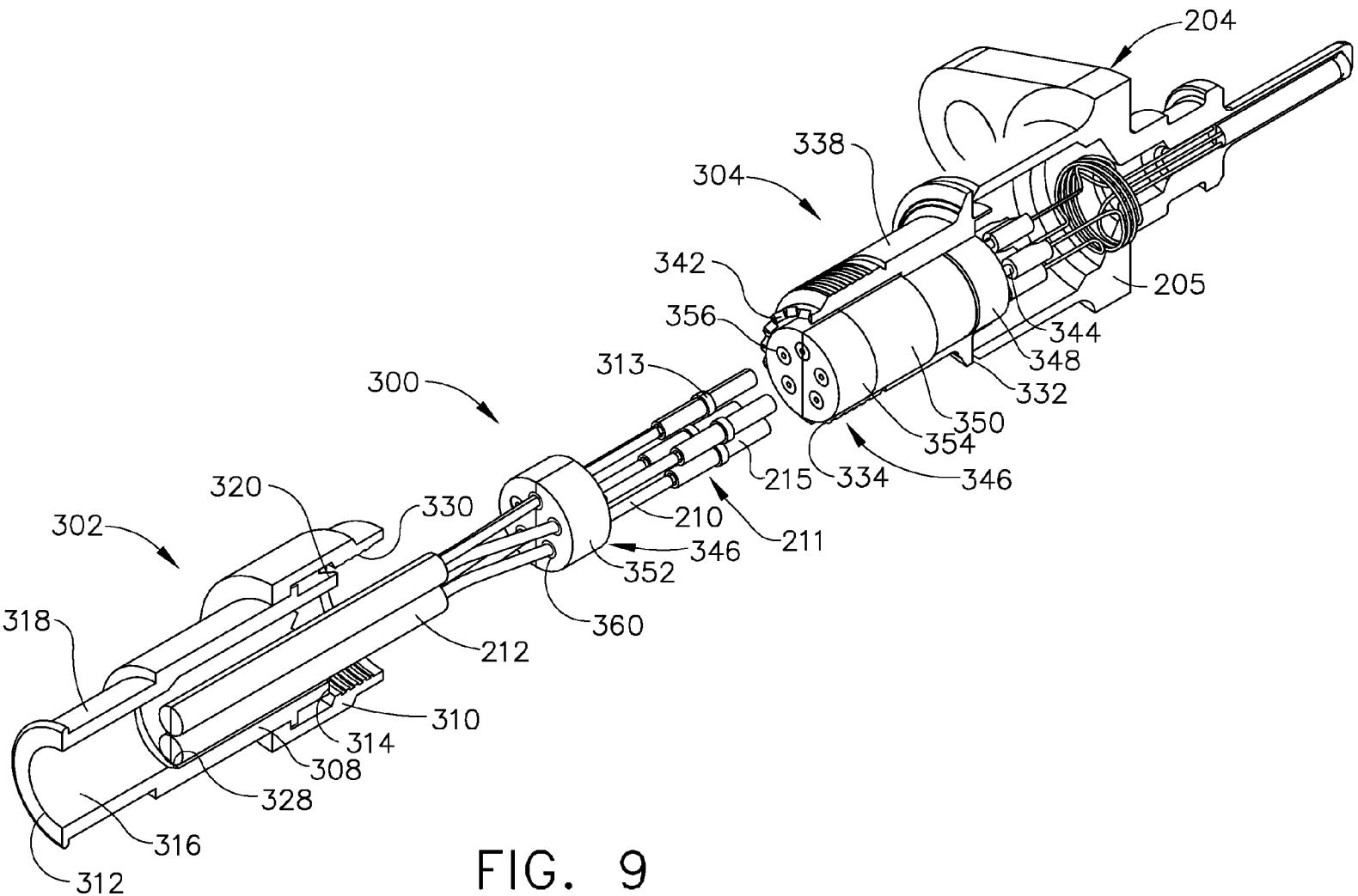
FIG. 9 is a partial perspective view of the connector assembly shown in FIG. 4 in a second disassembled state.

FIGS. 7, 8, and 9 are partial perspective views of connector assembly 300 in an assembled state, a first disassembled state, and a second disassembled state, respectively. Referring to FIG. 7, in the assembled state of connector assembly 300, second shell 304 is coupled (e.g., welded) to housing 205 of device 204 such that contacts 344 extend into passage 340 via proximal end 332 of second shell 304. Ceramic structure 348, dielectric structure 350, and second grommet structure 354 are fixedly retained within passage 340 (e.g., via adhesive) such that contacts 344 extend into dielectric structure 350 via through-ports 356. Additionally, first shell 302 is coupled to second shell 304 such that teeth 320 of distal end 314 mate with teeth 342 of distal end 334 and such that threaded inner surface 330 of coupling segment 310 interfaces with threaded outer surface 338 of second shell 304. Wires 210 extend through passage 322 of first shell 302 (e.g., into proximal end 312 and out of distal end 314) via through-ports 360 of first grommet structure 352. Wires 210 also extend into passage 340 of second shell 304 via distal end 334 such that wires extend through second grommet structure 354 and into dielectric structure 350 via through-ports 356.

In this manner, socket contact 215 of each wire 210 receives one associated contact 344 in order to couple (e.g., electrically couple or communicatively couple) wires 210 to device 204. To facilitate maintaining the coupling between socket contacts 215 and contacts 344, retainer rings 213 of terminations 211 are inserted into corresponding retainer sleeves 358, and the tapered shape of retainer sleeves 358 restricts uncoupling of socket contacts 215 from contacts 344. Because first grommet structure 352 and second grommet structure 354 are substantially aligned (i.e., through-ports 360, 356 are substantially aligned), wires 210 are maintained in a substantially linear, parallel orientation as they extend from first grommet structure 352 into second grommet structure 354, thereby spacing wires 210 relative to one another and relative to shells 302, 304 to minimize interference and chaffing.

Referring now to FIGS. 8 and 9, to disassemble connector assembly 300 (i.e., to uncouple wires 210 from device 204), coupling segment 310 of first shell 302 is unthreaded from second shell 304, and first shell 302 is displaced toward (and, in some embodiments, over) covering 212 along wires 210 from a first position (FIG. 7) in which first grommet structure 352 is disposed within passage 322 to a second position (FIG. 8) in which first grommet structure 352 is exposed outside of passage 322. With first grommet structure 352 exposed outside of passage 322, first grommet structure 352 is displaced toward covering 212 along wires 210 to provide sufficient spacing between first grommet structure 352 and second grommet structure 354 to enable removal of wires 210 from second shell 304 (FIG. 9). To remove wires 210 from second shell 304, retainer rings 213 are uncoupled from retainer sleeves 358, socket contacts 215 are uncoupled from contacts 344, and wires 210 are pulled out of through-ports 356 (e.g., tools may be inserted into through-ports 356 to grip and uncouple terminations 211). With socket contacts 215 uncoupled from contacts 344, device 204 is no longer electrically or communicatively coupled to wires 210, thereby better enabling device 204 (e.g., the sensor device) and/or harness 202 (e.g., wires 210) to be repaired or replaced in the field. By suitably reversing the aforementioned steps, connector assembly 300 may be reassembled after the desired repair or replacement.

The methods and systems described herein facilitate enabling a device to be coupled and uncoupled from a wire. The methods and systems described herein also facilitate exposing wire terminations for repair or replacement when a device is uncoupled from the wire. The methods and systems described herein further facilitate reducing the number of components associated with a connector assembly, thereby reducing the raw materials used to fabricate the connector assembly and reducing space and weight of the connector assembly. The methods and systems described herein therefore facilitate simplifying the interface between a wire and an associated device to reduce costs associated with manufacturing, installing, and operating a system.

Exemplary embodiments of a connector assembly and a method of fabricating the same are described above in detail. The methods and systems are not limited to the specific embodiments described herein, but rather, components of the methods and systems may be utilized independently and separately from other components described herein. For example, the methods and systems described herein may have other industrial and/or consumer applications and are not limited to practice with only electrical harnesses of gas turbine engines as described herein. Rather, the present invention can be implemented and utilized in connection with many other industries.

While the invention has been described in terms of various specific embodiments, those skilled in the art will recognize that the invention can be practiced with modification within the spirit and scope of the claims.

What is claimed is:

1. A method of fabricating a connector assembly for connecting a wire to a device of a gas turbine engine, said method comprising:

providing a wire having a termination;

providing a first shell having a first proximal end, a first distal end, and a first passage extending from the first proximal end to the first distal end; and coupling the first shell to the wire such that the wire extends into the first passage through the first proximal end, wherein the first shell is displaceable along the wire relative to the termination.

2. A method in accordance with claim 1, further comprising coupling a first grommet structure to the wire such that the first shell is displaceable along the wire from a first position in which the first grommet structure is disposed within the first passage to a second position in which the first grommet structure is exposed outside of the first passage.

3. A method in accordance with claim 2, further comprising coupling the first grommet structure to the wire such that the first grommet structure is displaceable along the wire relative to the first shell.

4. A method in accordance with claim 1, further comprising:

providing a second shell configured to be coupled to the first shell and the device, wherein the second shell has a second proximal end, a second distal end, and a second passage extending from the second proximal end to the second distal end;

providing a dielectric structure configured to receive the termination of the wire; and fixedly coupling the dielectric structure within the second passage of the second shell such that the termination is insertable into the dielectric structure through the second distal end of the second shell.

5. A method in accordance with claim 4, wherein the device has a contact, said method further comprising:

providing the dielectric structure as being configured to receive the contact of the device; and fixedly coupling the dielectric structure within the second passage of the second shell such that the contact is insertable into the dielectric structure through the second proximal end of the second shell for coupling the termination to the contact within the dielectric structure.

6. A method in accordance with claim 4, further comprising fixedly coupling a second grommet structure within the second shell such that the second grommet structure is configured to receive the termination of the wire before the termination of the wire is inserted into the dielectric structure.

7. A connector assembly for connecting a termination of a wire to a device of a gas turbine engine, said connector assembly comprising:

a first grommet structure configured to be coupled to the wire; and a first shell comprising a first proximal end, a first distal end, and a first passage extending from said first proximal end to said first distal end, wherein said first shell is configured to be coupled to the wire such that the wire extends into said first passage through said first proximal end, said first shell configured to be displaceable along the wire relative to the termination and said first grommet structure from a first position in which said first grommet structure is disposed within said first passage to a second position in which said first grommet structure is exposed outside of said first passage.

8. A connector assembly in accordance with claim 7, wherein said first grommet structure is configured to be displaceable along the wire relative to said first shell.

9. A connector assembly in accordance with claim 7, further comprising:

a second shell configured to be coupled to said first shell and the device, wherein said second shell comprises a second proximal end, a second distal end, and a second passage extending from said second proximal end to said second distal end; and a dielectric structure fixedly coupled within said second passage of said second shell, wherein said dielectric structure is configured to receive the termination of the wire through said second distal end of said second shell.

10. A connector assembly in accordance with claim 9, wherein the device has a contact, said dielectric structure further configured to receive the contact of the device through said second proximal end of said second shell for coupling the termination to the contact within said dielectric structure.

11. A connector assembly in accordance with claim 9, further comprising a second grommet structure fixedly coupled within said second shell such that said second grommet structure is configured to receive the termination of the wire before the termination of the wire is inserted into said dielectric structure.

12. A gas turbine engine comprising:

a device;

a wire comprising a termination; and a connector assembly operatively coupling said termination to said device, wherein said connector assembly comprises a first shell comprising:

a first proximal end;

a first distal end; and a first passage extending from said first proximal end to said first distal end, wherein said first shell is coupled to said wire such that said wire extends into said first passage through said first proximal end, said first shell displaceable along said wire relative to said termination.

13. A gas turbine engine in accordance with claim 12, wherein said connector assembly further comprises a first grommet structure coupled to said wire such that said first shell is displaceable along said wire from a first position in which said first grommet structure is disposed within said first passage to a second position in which said first grommet structure is exposed outside of said first passage.

14. A gas turbine engine in accordance with claim 13, wherein said first grommet structure is displaceable along said wire relative to said first shell.

15. A gas turbine engine in accordance with claim 12, wherein said connector assembly further comprises:

a second shell coupled to said device and said first shell, wherein said second shell comprises a second proximal end, a second distal end, and a second passage extending from said second proximal end to said second distal end; and a dielectric structure fixedly coupled within said second passage of said second shell, wherein said dielectric structure receives said termination of said wire through said second distal end of said second shell.

16. A gas turbine engine in accordance with claim 15, wherein said device comprises a contact, said dielectric structure receiving said contact of said device through said second proximal end of said second shell such that said termination is coupled to said contact within said dielectric structure.

17. A gas turbine engine in accordance with claim 16, wherein said termination is removable from said contact.

18. A gas turbine engine in accordance with claim 15, wherein said connector assembly further comprises a second grommet structure fixedly coupled within said second shell such that said second grommet structure receives said termination of said wire before said termination of said wire is inserted into said dielectric structure.

19. A gas turbine engine in accordance with claim 15, wherein said second shell and said first shell are threadably coupled together.

20. A gas turbine engine in accordance with claim 19, wherein said first shell comprises first teeth at said first distal end and wherein said second shell comprises second teeth at said second distal end, said first teeth and said second teeth being mated together when said first shell is coupled to said second shell.

* * * * *